US006591468B1

(12) United States Patent
Douglas

(10) Patent No.: US 6,591,468 B1
(45) Date of Patent: Jul. 15, 2003

(54) SINK LIFTING DEVICE

(76) Inventor: John Q. Douglas, 2312 S. Manor Dr., Sacramento, CA (US) 95822

( * ) Notice: Subject to any disclaimer, the term of this patent is extended or adjusted under 35 U.S.C. 154(b) by 36 days.

(21) Appl. No.: 09/976,735

(22) Filed: Oct. 12, 2001

(51) Int. Cl.[7] ..... B25B 5/14
(52) U.S. Cl. ..... 29/266; 269/49
(58) Field of Search ..... 254/98, 133, 134, 254/1; 29/259, 256, 266; 269/49

(56) References Cited

U.S. PATENT DOCUMENTS

| | | | | | |
|---|---|---|---|---|---|
| 2,584,124 | A | * | 2/1952 | Gustafson | 269/49 |
| 2,746,062 | A | * | 5/1956 | Waltz | 269/49 |
| 3,247,588 | A | * | 4/1966 | Duke | 254/98 |
| 3,268,994 | A | * | 8/1966 | Riley | 254/98 |
| 3,318,010 | A | | 5/1967 | Mahl | |
| 3,861,649 | A | | 1/1975 | Mosley | |
| 3,957,247 | A | | 5/1976 | Haller | |
| 4,157,811 | A | | 6/1979 | Haller et al. | |
| 4,615,514 | A | * | 10/1986 | Hamlin | 269/49 |
| 4,835,798 | A | | 6/1989 | Hernandez | |
| 4,989,311 | A | * | 2/1991 | Rosin | 29/259 |
| 5,154,024 | A | | 10/1992 | Noel | |
| D382,788 | S | | 8/1997 | Wages | |

* cited by examiner

*Primary Examiner*—Robert C. Watson

(57) ABSTRACT

A sink lifting device for aiding in the removal and installation of sink assemblies. The sink lifting device includes a base member designed for extending over a sink, a lifting assembly that is coupled to the base member such that the lifting assembly is couplable to a sink for removal and installation of the sink.

11 Claims, 2 Drawing Sheets

SINK LIFTING DEVICE

BACKGROUND OF THE INVENTION

1. Field of the Invention

The present invention relates to sink lifting devices and more particularly pertains to a new sink lifting device for aiding in the removal and installation of sink assemblies.

2. Description of the Prior Art

The use of sink lifting devices is known in the prior art. More specifically, sink lifting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,154,024; U.S. Pat. No. 4,835,798; U.S. Pat. No. 3,861,649; U.S. Pat. No. 4,157,811; U.S. Pat. No. 3,318,010; U.S. Pat. No. Des. 382,788; and U.S. Pat. No. 3,957,247.

While these devices fulfill their respective, particular objectives and requirements, the aforementioned patents do not disclose a new sink lifting device. The inventive device includes a base member designed for extending over a sink, a lifting assembly that is coupled to the base member such that the lifting assembly is couplable to a sink for removal and installation of the sink.

In these respects, the sink lifting device according to the present invention substantially departs from the conventional concepts and designs of the prior art, and in so doing provides an apparatus primarily developed for the purpose of aiding in the removal and installation of sink assemblies.

SUMMARY OF THE INVENTION

In view of the foregoing disadvantages inherent in the known types of sink lifting devices now present in the prior art, the present invention provides a new sink lifting device construction wherein the same can be utilized for aiding in the removal and installation of sink assemblies.

The general purpose of the present invention, which will be described subsequently in greater detail, is to provide a new sink lifting device apparatus and method which has many of the advantages of the sink lifting devices mentioned heretofore and many novel features that result in a new sink lifting device which is not anticipated, rendered obvious, suggested, or even implied by any of the prior art sink lifting devices, either alone or in any combination thereof.

To attain this, the present invention generally comprises a base member designed for extending over a sink, a lifting assembly that is coupled to the base member such that the lifting assembly is couplable to a sink for removal and installation of the sink.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sink lifting device apparatus and method which has many of the advantages of the sink lifting devices mentioned heretofore and many novel features that result in a new sink lifting device which is not anticipated, rendered obvious, suggested, or even implied by any of the prior art sink lifting devices, either alone or in any combination thereof.

It is another object of the present invention to provide a new sink lifting device which may be easily and efficiently manufactured and marketed.

It is a further object of the present invention to provide a new sink lifting device which is of a durable and reliable construction.

An even further object of the present invention is to provide a new sink lifting device which is susceptible of a low cost of manufacture with regard to both materials and labor, and which accordingly is then susceptible of low prices of sale to the consuming public, thereby making such sink lifting device economically available to the buying public.

Still yet another object of the present invention is to provide a new sink lifting device which provides in the apparatuses and methods of the prior art some of the advantages thereof, while simultaneously overcoming some of the disadvantages normally associated therewith.

Still another object of the present invention is to provide a new sink lifting device for aiding in the removal and installation of sink assemblies.

Yet another object of the present invention is to provide a new sink lifting device which includes a base member designed for extending over a sink, a lifting assembly that is coupled to the base member such that the lifting assembly is couplable to a sink for removal and installation of the sink.

Still yet another object of the present invention is to provide a new sink lifting device that is easily attached to the sink, saving time.

Even still another object of the present invention is to provide a new sink lifting device that can be utilized on either a single or double drain design.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
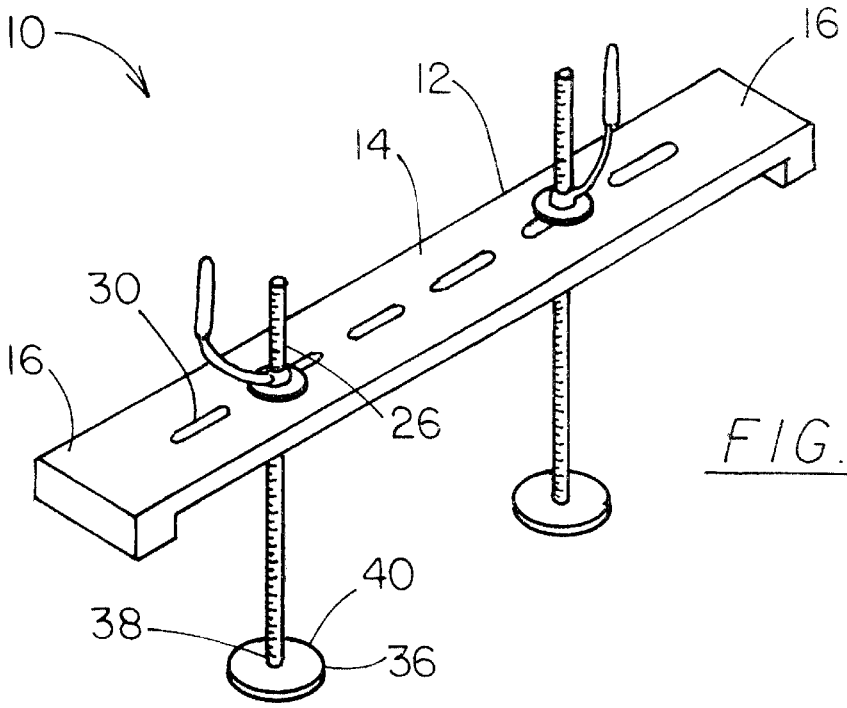
FIG. 1 is a schematic perspective view of a new sink lifting device according to the present invention.
Figure 2:
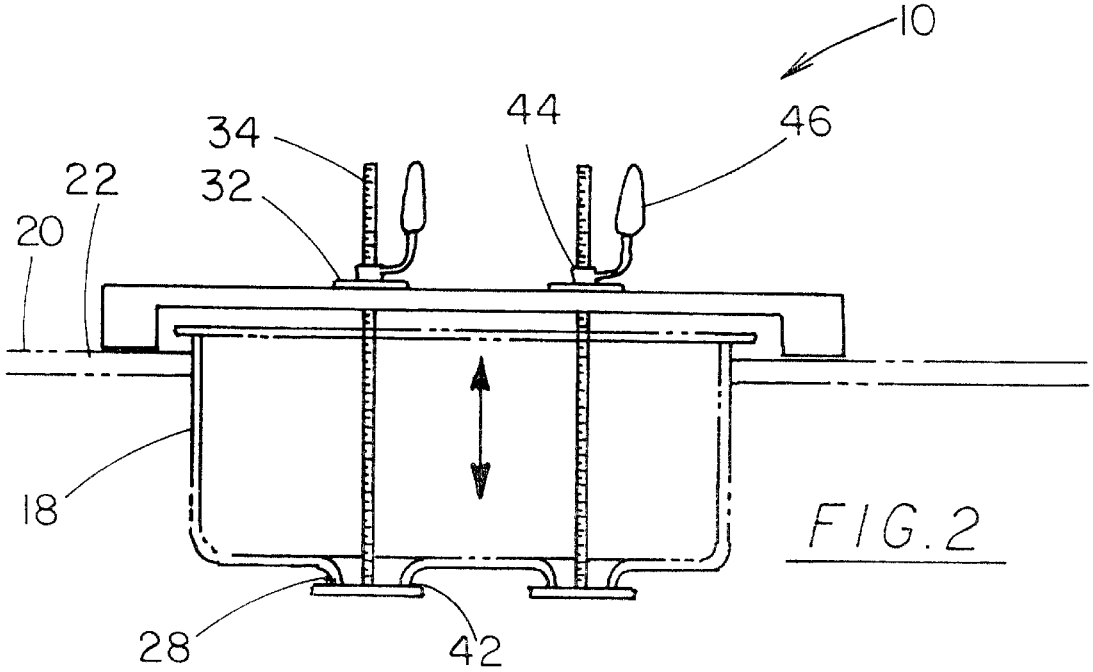
FIG. 2 is a schematic side view of the present invention.
Figure 3:
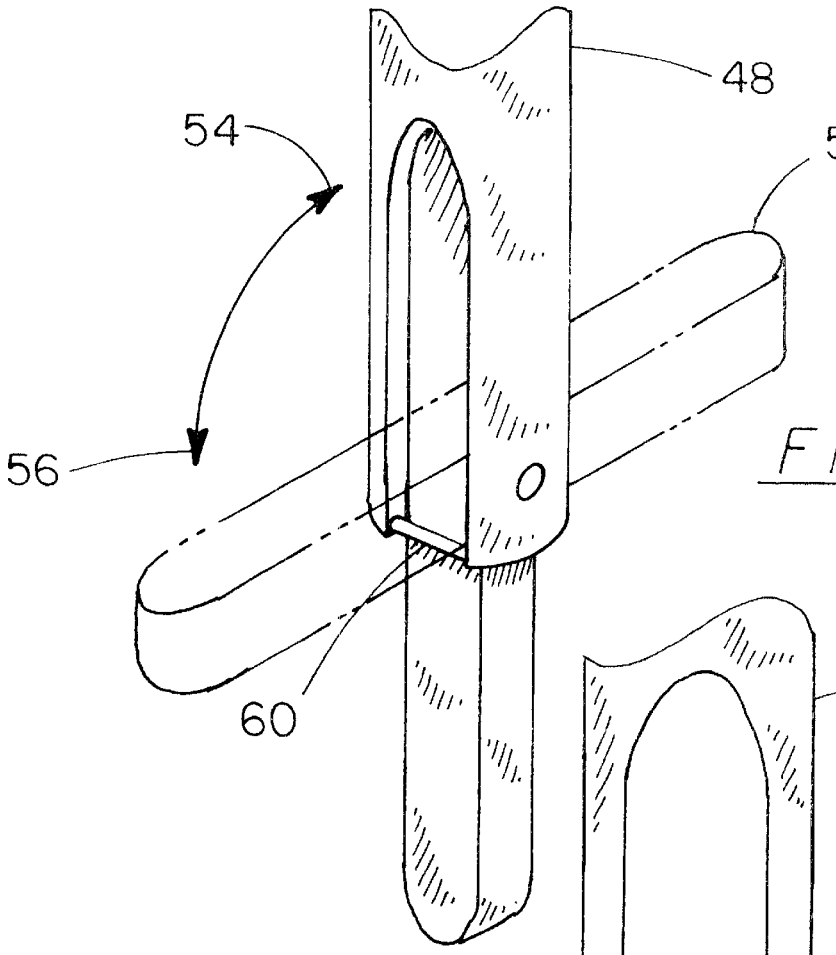
FIG. 3 is a schematic perspective view of an alternative design for the engaging member of the present invention.
Figure 4:
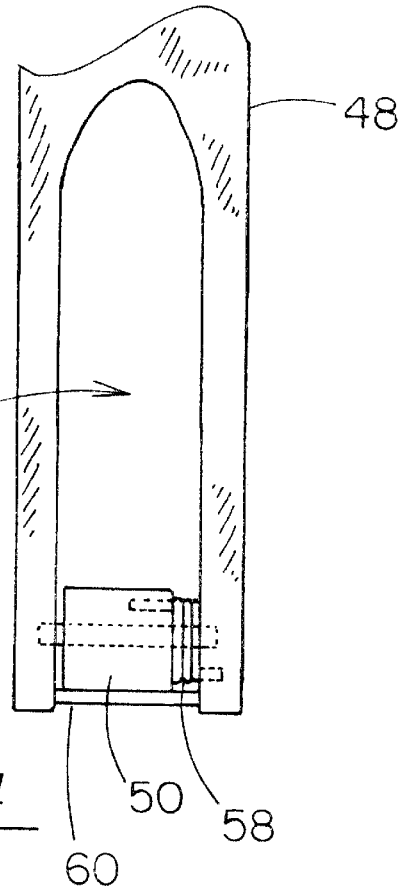
FIG. 4 is a schematic side view of an alternative design for the engaging member of the present invention.

With reference now to the drawings, and in particular to FIGS. 1 through 4 thereof, a new sink lifting device embodying the principles and concepts of the present invention and generally designated by the reference numeral 10 will be described.

As best illustrated in FIGS. 1 through 4, the sink lifting device 10 generally comprises a base member 12 includes a main portion 14 and pair of end portions 16. The main portion 14 is designed for extending over the sink 18. Each of the end portions 16 is designed for engaging a top surface 20 of a countertop 22 on opposing sides of the sink 18 when the main portion 14 is positioned over the sink 18.

A plurality of lifting assemblies 26 each is coupled to the main portion 14 of the base assembly. Each of the lifting assemblies 26 is designed for selectively engaging one of a plurality of drains 28 of the sink 18 when each of the lifting assemblies 26 is coupled to the base member 12. Each of the lifting assemblies 26 is vertically positionable with respect to the base member 12 such that vertical adjustment of each of the lifting assemblies 26 is designed for raising and lowering the sink 18 with respect to the base member 12. The base member 12 is designed for facilitating lifting of the sink 18 when the lifting assembly is vertically adjusted such that the sink 18 abuts the base member 12.

The main portion 14 of the base member 12 includes a plurality of slots 30. Each of the slots 30 is positioned along a longitudinal axis of the main portion 14 of the base member 12. The lifting assembly is for selectively extending through one of the slots 30 such that the lifting assembly can be aligned with the drain 28 of the sink 18.

Each of the end portions 16 of the base member 12 includes a spacer 32. The spacer 32 of each of the end portions 16 is for extending downwardly from the main portion 14. The spacer 32 of each of the end portions 16 is designed for engaging the top surface of the countertop 22 such that the spacer 32 of each of the end portions 16 positions the main portion 14 above the sink 18.

Each of the lifting assemblies 26 includes a threaded rod 34. The threaded rod 34 extends through the main portion 14 of the base member 12. An engaging member 36 is coupled to an end 38 of the threaded rod 34 opposite the base member 12. The engaging member 36 is designed for selectively engaging the drain 28 of the sink 18. The engaging member 36 is rotatable with respect to the base member 12 such that rotation of the engaging member 36 rotates the threaded rod 34 with respect to the base member 12 thereby changing a distance between the base member 12 and the engaging member 36 when the sink 18 is to be raised and lowered.

The engaging member 36 of each of the lifting assemblies 26 comprises a disk 40. The disk 40 is positioned parallel to the base member 12. The disk 40 is designed for engaging an edge 42 of the drain 28 of the sink 18.

Each of the lifting assemblies 26 includes a fastener member 44 that is selectively coupled to the threaded rod 34 of each of the lifting assemblies 26. The fastener member 44 is coupled to the threaded rod 34 member opposite from the engaging member 36 such that the base member 12 is positioned between the fastener member 44 and the engaging member 36.

The fastener member 44 is rotatable with respect to the base member 12. The fastener member 44 is rotatable in a first direction such that rotating of the fastener member 44 in the first direction reduces the distance between the base member 12 and the engaging member 36 when the sink 18 is to be raised with respect to the base member 12. The fastener member 44 is rotatable in a second direction such that rotating of the fastener member 44 in the second direction increases the distance between the base member 12 and the engaging member 36 when the sink 18 is to be lowered with respect to the base member 12.

Each of the lifting assemblies 26 includes a handle portion 46. The handle portion 46 is coupled to the fastener member 44 such that the handle portion 46 extends away from the fastener member 44. The handle portion 46 is for facilitating rotation of the fastener member 44 with respect to the base member 12 when the user desires to raise and lower the sink 18.

Each of the lifting assemblies 26 includes a fastener member 44 selectively coupled to the threaded rod 34 of each of the lifting assemblies 26. The fastener member 44 is coupled to the threaded rod 34 member opposite from the engaging member 36 such that the base member 12 is positioned between the fastener member 44 and the engaging member 36.

As an alternate embodiment of the present invention, the engaging member 36 of each of the lifting assemblies 26 includes an anchor portion 48 and a bar portion 50. The anchor portion 48 is coupled to the threaded rod 34. The anchor portion 48 includes a cutout 52. The bar portion 50 is pivotally coupled to the anchor portion 48 within the cutout 52 such that the bar portion 50 is pivotal through the cutout 52 of the anchor portion 48.

The bar portion 50 is pivotal between a first position 54 and a second position 56. The first position 54 of bar portion 50 is for aligning the bar portion 50 with the anchor portion 48 when the engaging member 36 is to be passed through the drain 28 of the sink 18. The second position 56 of the bar portion 50 is for positioning the bar portion 50 perpendicular to the anchor portion 48 such that the bar portion 50 is designed for abutting against the edge 42 of the drain 28 of the sink 18 when the sink 18 is to raised and lowered.

The engaging member 36 includes a biasing member 58. The biasing member 58 is coupled between the anchor portion 48 and the bar portion 50 of the engaging member 36. The biasing member 58 biasing the bar portion 50 to the second position 56 when the engaging member 36 is passed through the drain 28 of the sink 18.

The engaging member 36 includes a stopping member 60. The stopping member 60 is coupled to the anchoring portion within the cutout 52 of the anchoring portion. The stopping member 60 abuts against the bar portion 50 of the engaging member 36 such that the stopping member 60 is for preventing over-pivoting of the bar portion 50 past the first and second positions 54, 56.

It should be noted from the claims that follow that the present invention can be used for sinks with both single and double drains, although only a sink with multiple drains are depicted in the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sink lifting device for aiding in lifting of and placing a sink by a user, the sink lifting device comprising:

a base member having a main portion and pair of end portions, said main portion being adapted for extending over the sink, each of said end portions being adapted for engaging a top surface of a counter top on opposing sides of the sink when said main portion is positioned over the sink;

at least one lifting assembly being coupled to said main portion of said base member, said lifting assembly being adapted for selectively engaging a drain of the sink when said lifting assembly is coupled to said base member, said lifting assembly being vertically positionable with respect to said base member such that vertical adjustments of said lifting assembly is adapted for raising and lowering the sink with respect to said base member, said base member being adapted for facilitating lifting of the sink when said lifting assembly is vertically adjusted such that the sink abuts said base member;

said lifting assembly having a threaded rod, said threaded rod extending through said main portion of said base member, an engaging member being coupled to an end of said threaded rod opposite said base member, said engaging member being adapted for selectively engaging the drain of the sink, said engaging member being rotatable with respect to said base member such that rotation of said engaging member rotates said threaded rod with respect to said base member thereby changing a distance between said base member and said engaging member when the sink is to be raised and lowered;

said engaging member of said lifting assembly having an anchor portion and a bar portion, said anchor portion being coupled to said threaded rod, said anchor portion having a cut out, said bar portion being pivotally coupled to said anchor portion within said cut out such that said bar portion is pivotal through said cut out of said anchor portion, said bar portion being pivotal between a first position and a second position, said first position of bar portion being for aligning said bar portion with said anchor portion when said engaging member is passed through the drain of the sink, said second position of said bar portion being for positioning said bar portion perpendicular to said anchor portion such that said bar portion is adapted for abutting against an edge of the drain of the sink when the sink is to raised and lowered; and said engaging member having a stopping member, said stopping member being coupled to said anchoring portion within said cut out of said anchoring portion, said stopping member abuts against said bar portion of said engaging member such that said stopping member is for preventing over pivoting of said bar portion past said first position and said second position.

2. The sink lifting device as set forth in claim 1, further comprising:

said main portion of said base member having a plurality of slots, each of said slots being positioned along a longitudinal axis of said main portion of said base member, said lifting assembly being for selectively extending through one of said slots such that said lifting assembly can be aligned with the drain of the sink.

3. The sink lifting device as set forth in claim 1, further comprising:

each of said end portions of said base member having a spacer, said spacer of each of said end portions being for extending downwardly from said main portion, said spacer of each of said end portions being adapted for engaging the top surface of the counter top such that said spacer of each of said end portions positions said main portion above the sink.

4. The sink lifting device as set forth in claim 1, further said engaging member having a biasing member, said biasing member being coupled between said anchor portion and said bar portion of said engaging member, said biasing member biasing said bar portion to said second position when said engaging member is passed through the drain of the sink.

5. The sink lifting device as set forth in claim 1, further comprising:

said lifting assembly having a fastener member being selectively coupled to said threaded rod of said lifting assembly, said fastener member being coupled to said threaded rod member opposite from said engaging member such that said base member is positioned between said fastener member and said engaging member, said fastener member being rotatable with respect to said base member, said fastener member being rotatable in a first direction such that rotating of said fastener member in said first direction reduces said distance between said base member and said engaging member when the sink is to be raised with respect to said base member, said fastener member being rotatable in a second direction such that rotating of said fastener member in said second direction increases said distance between said base member and said engaging member when the sink is to be lowered with respect to said base member.

6. The sink lifting device as set forth in claim 5, further comprising:

said lifting assembly having a handle portion, said handle portion being coupled to said fastener member such that said handle portion extends away from said fastener member, said handle portion being for facilitating rotation of said fastener member with respect to said base member when the user desires to raise and lower the sink.

7. A sink lifting device for aiding in lifting of and placing a sink by a user, the sink lifting device comprising:

a base member having a main portion and pair of end portions, said main portion being adapted for extending over the sink, each of said end portions being adapted for engaging a top surface of a counter top on opposing sides of the sink when said main portion is positioned over the sink;

at least one lifting assembly being coupled to said main portion of said base member, said lifting assembly being adapted for selectively engaging a drain of the sink when said lifting assembly is coupled to said base member, said lifting assembly being vertically positionable with respect to said base member such that vertical adjustments of said lifting assembly is adapted for raising and lowering the sink with respect to said base member, said base member being adapted for facilitating lifting of the sink when said lifting assembly is vertically adjusted such that the sink abuts said base member;

a plurality of lifting assemblies each being coupled to said main portion of said base assembly, each of said lifting assemblies being adapted for selectively engaging one of a plurality of drains of the sink when each of said lifting assemblies is coupled to said base member, each of said lifting assemblies being vertically positionable with respect to said base member such that vertical adjustments of each of said lifting assemblies is adapted for raising and lowering the sink with respect to said base member;

each of said lifting assemblies having a threaded rod, said threaded rod extending through said main portion of said base member, an engaging member being coupled to an end of said threaded rod opposite said base member, said engaging member being adapted for selectively engaging the drain of the sink, said engaging member being rotatable with respect to said base member such that rotation of said engaging member rotates said threaded rod with respect to said base member thereby changing a distance between said base member and said engaging member when the sink is to be raised and lowered; and said engaging member of each of said lifting assemblies having an anchor portion and a bar portion, said anchor portion being coupled to said threaded rod, said anchor portion having a cut out, said bar portion being pivotally coupled to said anchor portion within said cut out such that said bar portion is pivotal through said cut out of said anchor portion, said bar portion being pivotal between a first position and a second position, said first position of bar portion being for aligning said bar portion with said anchor portion when said engaging member is passed through the drain of the sink, said second position of said bar portion being for positioning said bar portion perpendicular to said anchor portion such that said bar portion is adapted for abutting against an edge of the drain of the sink when the sink is to raised and lowered.

8. The sink lifting device as set forth in claim 7, further comprising:

said engaging member having a biasing member, said biasing member being coupled between said anchor portion and said bar portion of said engaging member, said biasing member biasing said bar portion to said second position when said engaging member is passed through the drain of the sink.

9. The sink lifting device as set forth in claim 7, further comprising:

each of said lifting assemblies having a fastener member being selectively coupled to said threaded rod of each of said lifting assemblies, said fastener member being coupled to said threaded rod member opposite from said engaging member such that said base member is positioned between said fastener member and said engaging member, said fastener member being rotatable with respect to said base member, said fastener member being rotatable in a first direction such that rotating of said fastener member in said first direction reduces said distance between said base member and said engaging member when the sink is to be raised with respect to said base member, said fastener member being rotatable in a second direction such that rotating of said fastener member in said second direction increases said distance between said base member and said engaging member when the sink is to be lowered with respect to said base member.

10. The sink lifting device as set forth in claim 9, further comprising:

each of said lifting assemblies having a handle portion, said handle portion being coupled to said fastener member such that said handle portion extends away from said fastener member, said handle portion being for facilitating rotation of said fastener member with respect to said base member when the user desires to raise and lower the sink.

11. A sink lifting device for aiding in lifting of and placing a sink by a user, the sink lifting device comprising:

a base member having a main portion and pair of end portions, said main portion being adapted for extending over the sink, each of said end portions being adapted for engaging a top surface of a counter top on opposing sides of the sink when said main portion is positioned over the sink;

a plurality of lifting assemblies each being coupled to said main portion of said base assembly, each of said lifting assemblies being adapted for selectively engaging one of a plurality of drains of the sink when each of said lifting assemblies is coupled to said base member, each of said lifting assemblies being vertically positionable with respect to said base member such that vertical adjustments of each of said lifting assemblies is adapted for raising and lowering the sink with respect to said base member, said base member being adapted for facilitating lifting of the sink when said lifting assembly is vertically adjusted such that the sink abuts said base member;

said main portion of said base member having a plurality of slots, each of said slots being positioned along a longitudinal axis of said main portion of said base member, said lifting assembly being for selectively extending through one of said slots such that said lifting assembly can be aligned with the drain of the sink;

each of said end portions of said base member having a spacer, said spacer of each of said end portions being for extending downwardly from said main portion, said spacer of each of said end portions being adapted for engaging the top surface of the counter top such that said spacer of each of said end portions positions said main portion above the sink;

each of said lifting assemblies having a threaded rod, said threaded rod extending through said main portion of said base member, an engaging member being coupled to an end of said threaded rod opposite said base member, said engaging member being adapted for selectively engaging the drain of the sink, said engaging member being rotatable with respect to said base member such that rotation of said engaging member rotates said threaded rod with respect to said base member thereby changing a distance between said base member and said engaging member when the sink is to be raised and lowered;

said engaging member of said lifting assembly having an anchor portion and a bar portion, said anchor portion being coupled to said threaded rod, said anchor portion having a cut out, said bar portion being pivotally coupled to said anchor portion within said cut out such that said bar portion is pivotal through said cut out of said anchor portion, said bar portion being pivotal between a first position and a second position, said first position of bar portion being for aligning said bar portion with said anchor portion when said engaging member is passed through the drain of the sink, said second position of said bar portion being for positioning said bar portion perpendicular to said anchor portion such that said bar portion is adapted for abutting against an edge of the drain of the sink when the sink is to raised and lowered;

said engaging member having a biasing member, said biasing member being coupled between said anchor portion and said bar portion of said engaging member, said biasing member biasing said bar portion to said second position when said engaging member is passed through the drain of the sink;

said engaging member having a stopping member, said stopping member being coupled to said anchoring portion within said cut out of said anchoring portion, said stopping member abuts against said bar portion of said engaging member such that said stopping member is for preventing over pivoting of said bar portion past said first position and said second position;

each of said lifting assemblies having a fastener member being selectively coupled to said threaded rod of each of said lifting assemblies, said fastener member being coupled to said threaded rod member opposite from said engaging member such that said base member is positioned between said fastener member and said engaging member, said fastener member being rotatable with respect to said base member, said fastener member being rotatable in a first direction such that rotating of said fastener member in said first direction reduces said distance between said base member and said engaging member when the sink is to be raised with respect to said base member, said fastener member being rotatable in a second direction such that rotating of said fastener member in said second direction increases said distance between said base member and said engaging member when the sink is to be lowered with respect to said base member; and each of said lifting assemblies having a handle portion, said handle portion being coupled to said fastener member such that said handle portion extends away from said fastener member, said handle portion being for facilitating rotation of said fastener member with respect to said base member when the user desires to raise and lower the sink.

* * * * *